United States Patent [19]

Dickens

[11] 4,326,722

[45] Apr. 27, 1982

[54] TARGET FOR TOSSED MARBLES

[76] Inventor: James Dickens, 28 Westland St., Hartford, Conn. 06120

[21] Appl. No.: 236,066

[22] Filed: Feb. 19, 1981

[51] Int. Cl.[3] ..... A63B 63/02

[52] U.S. Cl. ..... 273/400

[58] Field of Search ..... 273/398, 399, 400, 401, 273/402, 403, 1.5 R, 181 A; 206/315 R, 315 B

[56] References Cited

U.S. PATENT DOCUMENTS

| | | | |
|---|---|---|---|
| D. 222,978 | 2/1972 | Vina | 273/400 |
| 1,527,988 | 3/1925 | McMurtie | 273/400 |
| 1,528,661 | 3/1925 | Ewing | 273/181 A |
| 3,050,304 | 8/1962 | Hulsebus | 273/1.5 R X |
| 3,134,594 | 5/1964 | Crowley | 273/1.5 R X |
| 3,802,703 | 4/1974 | Tassel | 273/1.5 R X |
| 4,177,992 | 12/1979 | Todokoro | 273/399 X |
| 4,266,764 | 5/1981 | Collins | 273/1.5 R X |

*Primary Examiner*—George J. Marlo

*Attorney, Agent, or Firm*—Fishman and Van Kirk

[57] ABSTRACT

A target game is presented wherein marbles or the like are tossed by contestants at two square or rectangular baskets mounted side-by-side on a wall. The two baskets are positioned above and fully surrounded by a large receptacle which catches any marbles which miss the baskets and the above mentioned wall is an elongated wall of the large receptacle. The lower end of the large receptacle includes a storage bin for marbles and an access door.

10 Claims, 1 Drawing Figure

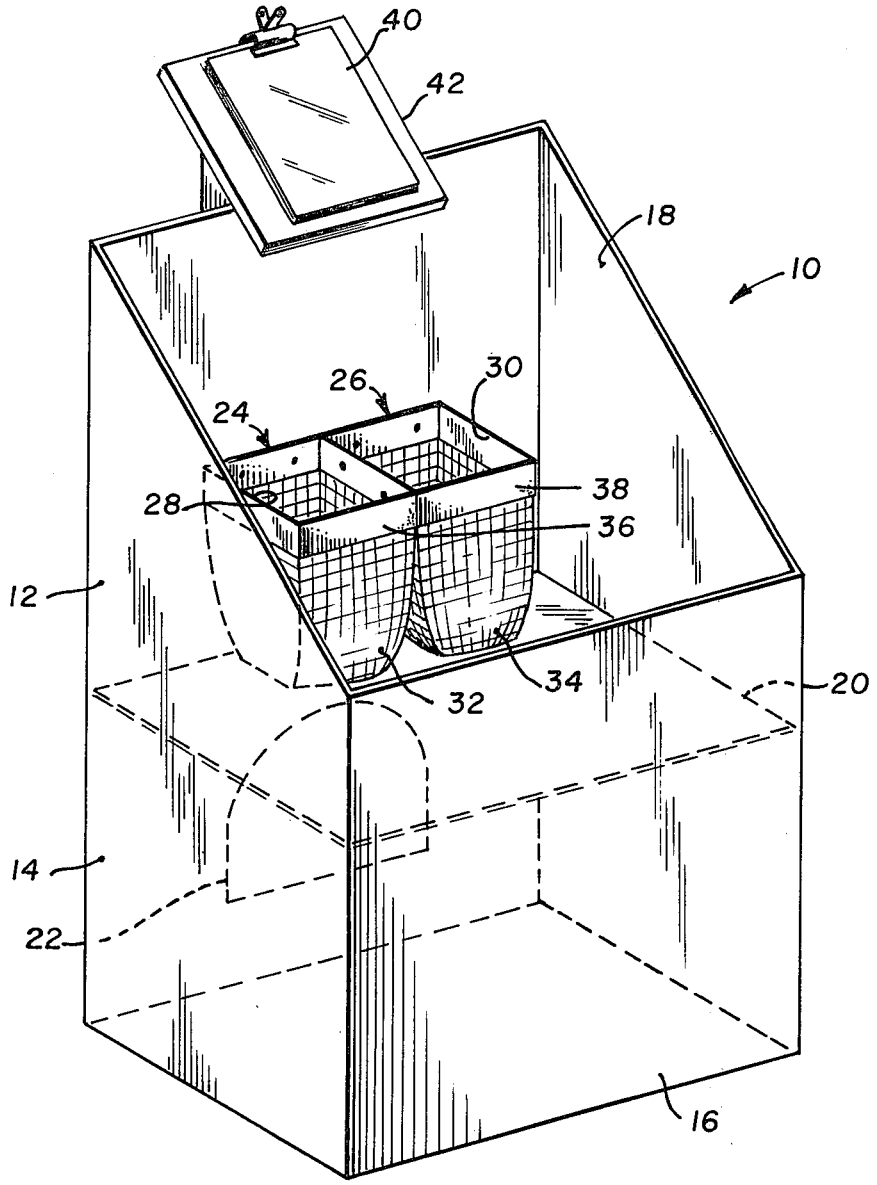
40
42
18
10
26
30
24
38
28
36
12
34
32
20
14
22
16

TARGET FOR TOSSED MARBLES

BACKGROUND OF THE INVENTION (1) Field of the Invention

The present invention relates to the field of target games. In particular the present invention is directed to an apparatus and method of use for a target game wherein the contestants are required to toss objects into a pair of baskets.

(2) Description of the Prior Art

Target games wherein contestants toss marbles or the like into baskets or containers are well known. These games have varying degrees of difficulty. In general these games require a contestant to toss the object in the direction of a basket from a distance. The more objects tossed into the basket the higher the score. To increase the difficulty of the game the baskets are usually made smaller and the distance from the basket increased. After repeated use of the game a contestant develops the skill required to toss the object into the baskets and the game ceases to be challenging.

SUMMARY OF THE PRESENT INVENTION

The present invention overcomes the above-discussed disadvantages and other deficiencies of the prior art by providing a target game wherein the skill needed to play the game is increased.

A target game in accordance with the present invention places two baskets side-by-side and requires a contestant to toss a marble or the like into his/her designated basket.

Generally the contestants start with a given number of marbles to toss. After all the marbles are tossed the contestant with more marbles in his/her basket wins. If a contestant tosses marbles into the other contestant's basket, those marbles belong to the other contestant. In order to increase the difficulty of the game the baskets are made square or rectangular and placed flush together. This prevents any marbles from dropping between the baskets.

The baskets are secured to a wall which allows the contestants to bank the marbles off of the wall and into the baskets. Beneath and surrounding the baskets is a much larger receptacle for catching any of the marbles which miss the baskets. The wall to which the baskets are secured is usually an extension of a wall of this receptacle. The winner also keeps any marbles which fall into this receptacle.

Furthermore, located beneath the large receptacle is a storage drawer in which the marbles or the like are stored.

By positioning the square or rectangular baskets together the difficulty of the game is increased, since a contestant must be cautious not to toss any marbles into their opponent's basket. Also, by placing a receptacle beneath and surrounding the baskets the loss of marbles is diminished.

BRIEF DESCRIPTION OF THE DRAWINGS

The present invention may be better understood and its numerous objects and advantages will become apparent to those skilled in the art by reference to the following drawing wherein:

FIG. 1 is a perspective view of the present invention, sections being shown in phantom.

DESCRIPTION OF THE PREFERRED EMBODIMENT

The present invention is directed to a target game wherein two contestants try to toss marbles or the like into their respectively assigned baskets. These contestants toss the same number of marbles, with the winner being the one with the most marbles in his/her basket. The difficulty of the game is increased by arranging the baskets side-by-side. This way if a contestant tosses a marble into the opponent's basket, the opponent keeps the marble.

An apparatus for use in the practice of the present invention is indented generally at 10 in FIG. 1. Apparatus 10 is comprised of a receptacle 12, as an upper section, and storage bin 14, as the lower section. Typically, apparatus 10 will be of rectangular shape, having four side walls with a bottom wall 16 and a top opening 18. Apparatus 10 may be comprised of any suitable material, such as plastic, metal or wood. The receptacle 12 and bin 14 are formed and separated by providing apparatus 10 with a wall 20. Wall 20 acts as both the base of receptacle 12 and the top of bin 14.

Bin 14 is used for storage of the marbles, or the like, (not shown). In order to provide access into bin 14 an aperture 22, is provided in any wall of apparatus 10 which forms bin 14. Preferably, a door, not shown, is provided to cover aperture 22 so that it may be opened and closed.

Receptacle 12 is used as the playing area of the present invention. Two baskets 24 and 26 are mounted side-by-side upon the back wall of receptacle 12, which is higher than the front wall. This allows a contestant to bank marbles off the back wall and into either basket 24 or 26. The combined sizes of baskets 24 and 26 are smaller than the top opening 18 of receptacle 12. Thus opening 18 fully surrounds the baskets 24 and 26. This insures that any marbles which miss the baskets 24 and 26 will be caught in receptacle 12. The actual sizes of baskets 24 and 26 will vary depending upon the desired difficulty of the game.

Baskets 24 and 26 are designed with top apertures 28 and 30 respectively. The remainder of the basket is closed, so that any marbles entering through apertures 28 and 30 will be trapped. While these baskets 24 and 26 may be comprised of any suitable material it is preferable to form them from collars 36 and 38 from which nylon mesh-knit bags 32 and 34 are hung. collars 36 and 38 are mounted to the back wall of receptacle 12 by any means, such as rivets.

In order to assure that the marbles do not fall between the two baskets 24 and 26 they are made with a square or rectangular shape. This allows the baskets 24 and 26 to be placed flush together. Preferably, the baskets 24 and 26 are permanently secured to one another.

A record of each opponent's score is maintained on score pad 40 which is retained on clip board 42. Clip board 42 may be either temporarily or permanently fastened to apparatus 10.

While the preferred embodiment of the invention has been described and illustrated, various modifications and substitutions may be made thereto without departing from the spirit and scope of the invention. Accordingly, it is to be understood that the present invention has been described by way of illustration and not limitation:

What is claimed is:

1. A game of skill comprising:

receptacle means, said receptacle means being an elongated structure, said receptacle means having at least one wall means which encloses said structure on all sides, said receptacle means having first and second ends, said first end being closed and forming the base of said receptacle means, said second end being open and forming the top of said receptacle means, said receptacle means having first and second chambers being formed by a horizontal partition means being positioned between said receptacle means first and second ends, said first chamber being enclosed by said first end, said partition means and said wall means, said first chamber being provided with a means of access through said sidewall means, said second chamber being formed by said second end, said partition means, and said wall means;

first basket means, said basket means being cuboidal in shape, said basket means being enclosed on five sides with an open first end;

second basket means, said basket means being cuboidal in shape, said basket means being enclosed on five sides with an open first end; and said first and second basket means being positioned in abutting side to side relationship with their first end being unobstructed and co-planar, said first and second basket means being further mounted within said second chamber upon said wall means with said first ends facing said receptacle means second end.

2. The game of skill of claim 1 wherein said receptacle means has four wall means forming said enclosed elongated structure.

3. The game of skill of claim 2 wherein one of said four wall means is longer, said longer wall means extending past the other said wall means at said receptacle means second end, said first and second basket means being mounted upon said longer wall means.

4. The game of skill of claim 3 wherein said first and second basket means comprises:

collar means, said collar means being generally rectangular, said collar means being mounted to said longer wall means; and bag means having an opening which is secured around said collar means.

5. The game of skill of claim 3 wherein said access means is an aperture provided within one of said four wall means forming said first chamber.

6. The game of skill of claim 5 further comprising:

door means being mounted upon said wall means to cover said aperture means.

7. The game of skill of claim 1 wherein a portion of said wall means forming said second chamber is elongated, said first and second basket means being mounted upon said elongated wall means portion.

8. The game of skill of claim 7 wherein said first and second basket means comprises:

collar means, said collar means being generally rectangular, said collar means being mounted to said elongated wall means portion; and bag means having an opening which is secured around said collar means.

9. The game of skill of claim 7 wherein said access means is an aperture provided with said wall means.

10. The game of skill of claim 9 further comprising:

door means being mounted upon said wall means to cover said aperture means.

* * * * *